US005570665A

United States Patent [19]

Regueiro

[11] Patent Number: 5,570,665

[45] Date of Patent: Nov. 5, 1996

[54] VALVE TRAIN FOR INTERNAL COMBUSTION ENGINE

[75] Inventor: Jose F. Regueiro, Rochester Hills, Mich.

[73] Assignee: Chrysler Corporation, Auburn Hills, Mich.

[21] Appl. No.: 416,245

[22] Filed: Apr. 4, 1995

[51] Int. Cl.[6] ..... F01L 1/14; F01L 1/16

[52] U.S. Cl. ..... 123/90.27; 123/90.48; 123/90.52; 123/90.55

[58] Field of Search ..... 123/90.27, 90.48, 123/90.52, 90.55

[56] References Cited

U.S. PATENT DOCUMENTS

| | | | |
|---|---|---|---|
| 3,303,833 | 2/1967 | Melling | 123/90.48 |
| 3,365,979 | 1/1968 | Ericson | 123/90.48 |
| 4,580,533 | 4/1986 | Oda et al. | 123/90.48 |
| 5,018,497 | 5/1991 | Tsuchida | 123/90.27 |
| 5,080,057 | 1/1992 | Batzill et al. | 123/193 H |
| 5,159,906 | 11/1992 | Fontichiaro et al. | 123/90.48 |
| 5,347,964 | 9/1994 | Reguiero | 123/90.27 |
| 5,392,744 | 2/1995 | Regueiro | 123/262 |

FOREIGN PATENT DOCUMENTS

| | | | |
|---|---|---|---|
| 202316 | 11/1983 | Japan | 123/90.48 |

OTHER PUBLICATIONS

*Automotive Handbook,* 2nd Edition ©Robert Bosch GmbH, pp. 318–319. 1986.

Philip H. Smith, "Valve Mechanisms for High–Speed Engines: Their Design and Develpment", pp. 64–69. (no date provided).

*Automotive Engineering,* Jan. 1995, pp. 23–25.

*MTU Magazine,* Jul.–Aug. 1993 edition, "Die Neuen Vierventil–Dieselmotoren von Merdedes–Benz", p. 329.

*Primary Examiner*—Weilun Lo

*Attorney, Agent, or Firm*—Kenneth H. MacLean

[57] ABSTRACT

A valve train for internal combustion engines utilizing an inverted bucket tappet with a pivot structure operatively disposed between the tappet and the end of the valve stem allowing the valves to be angulated with respect to each other and to the axis of the cylinder in both the transversal and the horizontal planes of the engine. Accordingly on a multi-valve engine, the valves extend radially from the associated combustion chamber to open and increase space in the center of the cylinder head for spark plugs, injectors, or pre-combustion chambers and so that the combustion chamber can be designed with a hemispherical surface, with tangentially disposed valve heads. The construction allows the use of large valves in conjunction with stronger, better-cooled valve seats and bridges. The tappets can be actuated conventionally by direct-acting overhead camshafts, by rocker arms and "T" bridges.

22 Claims, 9 Drawing Sheets

VALVE TRAIN FOR INTERNAL COMBUSTION ENGINE

FIELD OF THE INVENTION

This invention relates to internal combustion engines, and more particularly, to a new and improved engine valve train layout with angulated intake and exhaust valves radiating from the curved upper wall of the combustion chamber and having pivot structure between the valve stems and their tappets capable of being actuated by conventional cam shafts, pivot fingers, rocker arms and "T" or T-shaped bridges.

BACKGROUND OF THE INVENTION

Prior to the present invention, a wide range of valve trains with various valve and tappet configurations have been designed for internal combustion engines. A plurality of such valve trains are disclosed on pages 318–319 of *Automotive Handbook*, 2nd Edition © Robert Bosch GmbH, 1986 Postfach 50, D-7000 Stuttgart 1, Germany. While these valve trains are satisfactory for their intended applications, they are generally not suitable for use with hemispherical and similar combustion chambers designed for advanced engines and do not provide additional center space in the cylinder head for large, well cooled injection or ignition devices.

In U.S. Pat. No. 5,080,057, issued Jan. 14, 1992 to Batzill et al for "Cylinder Head of an Internal-Combustion Engine", a valve train is disclosed with intake and exhaust valves used with hemispherical combustion chambers that are inclined with respect to axes in the head construction of the engine. To actuate the disclosed valves, inverted bucket tappets are disposed so that they are in coaxial alignment with the valves. With such construction, camshafts with special conical cams or cam lobes are required to properly contact and actuate the valves for effective engine operation. The conical cam lobes of the Batzill construction are complicated and expensive. With such designs, a constant radius base circle on the lobe, requires a minimum tappet diameter increase over the basic tappet diameter of a conventional tappet and cam lobe, at least twice the radial distance between both sides of a conical cam lobe. Such a large tappet diameter, then, is counter-productive, for it forces the center of the lobe to be closer to the longitudinal center of the cylinder and results in less longitudinal plane inclination of the valves and reduced radial angle and curvature in the chamber.

While there are various valve train designs for other hemispherical combustion chambers, such designs usually involve only two-valve operation. Although in these designs both the intake and exhaust valves emanate radially from the combustion chamber, their angularity is only on the transversal plane of the engine. Such designs are disclosed in the valve train design book by Philip H. Smith, C.Eng., M.I.Mech. E., M.S.A.E., "Valve Mechanisms for High-Speed Engines, Their Design and Development", published by *Automobile Engineering* and printed in 1967 by G. T. Foulis & Co. Ltd., 1–5 Portpool Lane, E.C. 1, London, in association with the Whitefriars Press Ltd., also of London and Tonbridge in the U.K.

This Automobile Engineering publication also shows some designs of hemispherical chambers with four valves, driven by a variety of mechanisms. For example, the Hopwood-B.S.A. single cylinder motorcycle described in page 64 and shown by FIG. 3.23, indicates Single Overhead Camshafts, axially angled with respect to each other and connected by bevel gears, with the axis of each camshaft perpendicular to the single plane connecting each pair of same function valves and driving said valves conventionally by rocker arms operating in the plane of the valve stems.

The four cylinder, four valve per cylinder BMW racing engine of 1967 is also described in the *Automobile Engineering* publication. In this engine, the four radial valves were conventionally driven by two camshafts via push rods and rocker arms. While the constructions of this publication are of interest, they are not functionally or structurally like that of the present invention.

In addition to the above prior construction, one prior high speed diesel engine for passenger cars featuring a DOHC four valve with indirect injection is described in *Automotive Engineering*, January 1995 (vol. 103, No. 1), pages 23–25. This publication shows and describes a conventional DOHC, four valve design, with parallel valve stems for each pair of same function valves operating in conjunction with a hemispherical combustion chamber. In this prior design, the valves are angulated with respect to the longitudinal axis of the engine and increased head space is provided. The valves are not angulated with respect to each other in the longitudinal plane. However, the space is inadequate for many engine designs. Accordingly, the illustrated precombustion chamber of this engine is disposed quite far from the main combustion chamber, and is connected to it by a very long transfer passage.

The present invention is readily adaptable to such prior art engines to advantageously provide more room in the center of the cylinder head so that the prechamber can be substantially lowered and the transfer passage can be shorter thereby reducing the volumes outside of the main chamber and increasing the corresponding volumes in such main chamber so that deeper intake valve pockets can be cut on the piston top, allowing the increased intake valve travel at top Dead Center during overlap such as is required by a variable valve timing mechanism. The present invention provides advanced construction augmenting engine operation including cold starting from advanced intake valve closing and the associated increase in Effective Compression Ratio. Besides, with the reduced prechamber and transfer passage volumes and correspondingly reduced heat transfer and pumping losses, the present invention produces increased compression temperatures needed for cold starting and smooth and quiet idle operation.

The *Automotive Engineering* publication referenced above does not show or otherwise disclose the required shrouding of the heads of the parallel stem valves as they intersect the hemispherical combustion chamber machined in the cylinder head. Such shrouding is shown by FIG. 12, page 329, of an article by Von Ulrich Conrad et al entitled "Die Neuen Vierventil-Diesel Motoren Von Mercedes-Benz", published in the July-August 1993 edition of *MTU Magazine* (MTZ 54, 1992, 7–8) a technical publication of Motoren-Turbinen Union, a division of Daimler-Benz AG. The disclosed shrouding creates very large and empty pockets which, if the valves were laid-out radially, could be transferred to the top of the piston, thus allowing the installation of the variable valve timing mechanism. Furthermore, this shrouding is so large, taking effect through such a large arcuate section of the valve periphery, that the air flow through the open valve suffers and adversely effects engine operation. Accordingly, and in spite of a very sophisticated air induction system, the rated engine power only increases 20% over the older two-valve engine which the disclosed engine replaces.

In the applicant's invention, a 40% power increase may be readily obtained when applying this invention to four valve technology to replace the older two valve engines. Although intended to create more room so as to allow the placement of the spark plug or other combustion initiation means, the prior designs do not lend themselves to the larger radial angles desired in advanced engine design and as provided by the improvements of the present invention.

The prior designs lacked the slide-pivot articulation of the present invention to open enough center-space for diesel injectors or prechambers due, in some cases, to the placement of the camshaft along the center longitudinal axis of the cylinder head, which would physically interfere, apart from the fact that the valves were not angulated with respect to each other in the longitudinal plane of the engine.

More particularly, and in contrast to the prior constructions, the present invention provides a new and improved valve train that features the effective slide-pivot articulation interconnection of the bucket tappet with an outer end portion of the associated valve stem. This improved interface articulation between the tappet and valve stem allows the tappet to be stroked along a first axis and the associated valve to be stroked along a second axis which radiates from a point within the combustion chamber having a curved interior wall.

The present invention meets higher standards with (1) the provision of a new and improved combustion chamber, preferably hemispherical in configuration, in the head of the engine and (2) intake of air into and exhaust of gas from the engine cylinder by pairs of intake and exhaust valves laid out so that the heads of these valves are substantially tangent to the hemispherical wall of the combustion chamber and so that the stems of these valves extend radially therefrom and outwardly from one another.

The valve stems, accordingly, extend outwardly and preferably with respect to a common point of origin within the cylinder associated with the combustion chamber. The end portions of these stems interface with the inverted buckets or camshaft tappets by slide-pivot and force transmitting construction. With such articulation, conventional actuators, such as DOHC, pivot finger, rocker arms and "T" bridges can be used to displace each of the buckets along a first axis associated therewith and the associated intake or exhaust valve can be displaced along a second and intersecting axis that is coaxial with the radiating valve stem.

With this invention, specially shaped conical cam lobes are eliminated since the face of each cam lobe is generally parallel to the axis of the camshaft and makes full line contact with the tappet. This arrangement may further provide for and feature larger headed intake and exhaust valves resulting in increased and improved cylinder air intake and gas exhaust for improved engine operation. With the improved cylinder head layout, the bridges in the combustion chamber wall between the valve seats are enlarged providing for strengthened constructions. Bridge cooling is also improved since there are increased effective volumes in the water jacket in-between the divergent ports, especially the exhaust ports, in the longitudinal plane.

Another feature, object and advantage of this invention is to provide an internal combustion engine with a generally hemispherical combustion chamber having radiating intake and exhaust valves operated by inverted bucket tappets with internal universal articulation structures so that all the bucket tappets are displaced along parallel first axes while the associated valves are displaced along their respective radiating axes which are angled with respect to the first axes.

These and other features, objects and advantages of this invention will become more apparent from the following detailed description and drawings.

DETAILED DESCRIPTION

Figure 1:
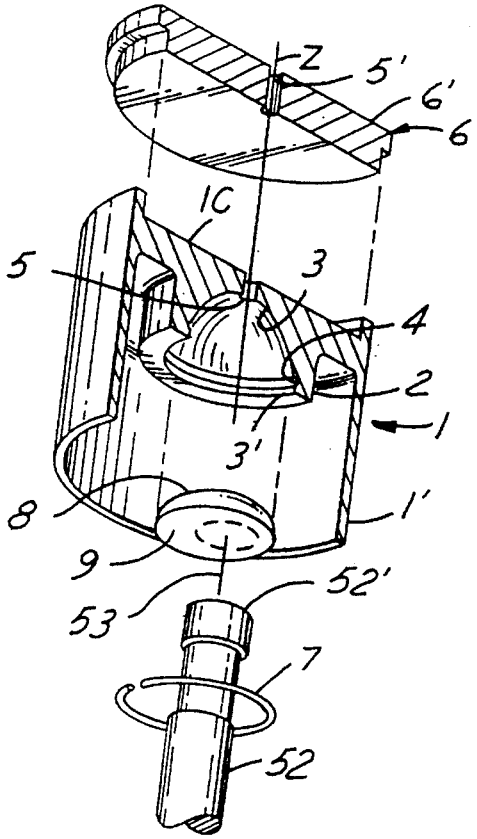
FIG. 1 is an exploded isometric view of a preferred embodiment of the invention.

Turning now in greater detail to the drawings, there is shown in FIG. 1 an exploded cross-section of the fundamental elements of the preferred embodiment of the invention. An inverted-bucket tappet 1 is formed with an extension 2 integrally joined with the interior bottom. A hemispherical cavity 3 is formed within the housing 2, with its center concentric with the axis of the tappet. The large open end 3' of the hemispherical cavity opens towards the open bottom end of the cylindrical skirt 1' of the tappet. An optional circular groove 4 is formed close to the open bottom end 3'. An optional flat cavity 1C is formed on the upper or top portion of the tappet 1. A small hole 5 is disposed coaxially in the center of the tappet to establish direct communication between the top cavity 1C and the hemispherical cavity 3. A shim 6, such as the illustrated stepped or double-diameter thick shim, can be disposed in the cavity 1C as explained in another of applicant's patent applications, U.S. Ser. No. 08/352,943, filed Dec. 9, 1994, now U.S. Pat. No. 5,445,119 and assigned to the assignee of this invention and hereby incorporated by reference.

A conventional thinner, single diameter shim (not shown) can also be installed in cavity 1C in lieu of the stepped shim 6 as shown. An optional orifice 5' may be disposed axially in the center of either of the shims. A pivot member 8 which is formed as a portion of a sphere has a flat bottom surface 9, is disposed snugly inside the hemispherical cavity 3 so that the hemispherical surfaces of each engage one another. This permits free but limited pivotal or rocking motion in the fashion of a ball and socket joint. To positively maintain member 8 in cavity 3, a snap ring 7 may optionally be disposed within groove 4 located near the open end of the hemispherical cavity 3. Alternately, a conventional rubber "0" ring, or any other kind or spring retainer (neither shown) can optionally be installed in lieu of the snap ring 7. A portion of a valve is shown in FIG. 1. Specifically, the upper end portion or tip 52' of an elongated valve stem 52 of the valve contacts the flat bottom end surface 9 of the rotular sliding pivot 8. Thus, forces on tappet 1 are transmitted to the valve through the pivot 8. In a contemplated alternate design of the rotular sliding pivot mechanism (not shown), an elongated cylindrical body extends between a hemispherically configured end surface, alike end surface 8, and a flat end surface, alike surface 9.

As shown in FIG. 1, the elongated valve stem portion 52 has an axis 53 which can be angulated with respect to the longitudinal axis "Z" of the tappet 1. The force transmitting means between tappet and valve accommodating this arrangement is the essence of the subject patent application. In addition, the center or contact point of the upper end portion or tip 52' of the valve stem 52, may optionally be offset from the axial center of the flat bottom portion of the rotular sliding pivot 8.

In operation, the body of the tappet reciprocates within a cylindrical guide (not shown) formed either as an integral part of the cylinder head (not shown) or of a separate member fixedly attached to the cylinder head (also not shown); guided by the cylindrical skirt 1' of the tappet 1. The downward reciprocating stroke of the tappet 1 follows the arcuate motion of an associated cam lobe of a camshaft (neither shown) as it contacts the top surface 6' of the shim 6. This downward motion of the tappet is transmitted to the valve through the ball and socket joint 3, 8, and 9. The associated valve is opened as a result. As the tappet and the valve are displaced from a seated or closed position (seated-valve position), the flat bottom surface 9 of the rotular sliding pivot 8 slides sideways or laterally with respect to the end portion or flat tip 52' of the valve stem 52 due to the angularity between the respective axis 53 and "Z" of the valve stem 52' and the tappet 1. As is known in the engine art, the valve is returned to the seated or closed position by the action of a spring (not shown) which engages a spring retainer (also not shown) fixedly attached to the valve stem by locks or keepers (also not shown). The closing action of the valve results from the release of the compressed spring, and this also moves the tappet and rotular mechanism upwardly. When the valve is seated or closed, a gap or valve lash is created between the top surface 6' of shim 6 and the base circle of the cam lobe (not shown).

A system is described above for providing a mechanical lash-setting system in which valve lash clearance is intentionally created, by design, to compensate for thermal expansions and contractions of the valve train and to accommodate wear of the different elements. To compensate for manufacturing tolerances of the different machined elements, one element in the axial line of the valve stem may be made with differing but controlled dimensions. This selectively dimensioned element is used to establish a desired valve lash during engine assembly and also during service. This compensate for wear, remachining of the valve seat, introduction of replacement parts, etc.

For a mass-produced engines having the subject valve mechanism, it is convenient to select shim 6 for the element used in varying thickness to establish valve lash. Alternately, the thickness of the rotular sliding pivot 8 may be varied.

For lubricating the rotular sliding pivot 8, holes 5 and 5' may be provided to direct oil to the rotular sliding pivot 8 inside cavity 3. When a valve is in its seated mode of operation, oil normally found adjacent the upper end of the tappets settles in a film over the top surface 6' of shim 6. The open gap or lash space between the lobe and the surface 6' allows oil to fill holes 5, 5' by gravity. As the camshaft rotates, the cam lobe closes the lash space and forces a small amount of oil down through the holes 5 and 5'. This maintains a flow of oil into the rotular cavity.

In a longitudinal plane of the engine, the angularity between the axis 53 of the tappet and the axis "Z" of the valve stem 52' may be used as a design element to allow more design freedom on where to locate the different elements of a valve train. Also, the placement of valve train components in the sideways or transversal plane of the engine can be useful as a design tool. Particularly for multi-valve engines, these new design freedoms made possible by the subject rotular mechanism can create increased space at the center of the cylinder head between a cylinder's valves and other valve components, and their respective ports. This increased space permits installation of conventional diesel injectors or precombustion chambers, in the case of diesel engines. In open-chamber (DI) diesel engine design, the increased space allows increased cooling passage volume to cool the operating tip of the injector at the combustion chamber.

Without the increased space afforded by the subject valve train design, conventionally sized spark plugs often could not be used in small gasoline engines having four, five or six-valved combustion chambers. With increased space, additional water cooling passage volume can also be provided near the hot end portion of the spark plug. This allows use of hotter spark plugs and reduces detonation tendencies. Additionally, more space can be created within the perimeter of the combustion chamber, allowing use of larger valves or larger bridges between valves, or a combination thereof. Larger valves normally increase air flow and exhaust flow which usually increases power output and may lower fuel consumption and emissions. Because the valves open in a radial inward direction away from the cylinder wall characterized by a very even opening gap about the entire perimeter of the valve head, their is a minimum of back or side shrouding than with other valve arrangements which further increasing air flow.

One further advantage inherent with increased space created by the subject valve train arrangement and design is improved cooling of the cylinder head and hence the valves in the valve bridge area between valves, particularly between a pair of exhaust valves. The increased space permits larger water cooling passages and use of bigger and stronger cores for casting cylinder heads. This advantage will be explained later in reference to FIG. 6.

With respect to combustion benefits, the subject valve train provides a relatively smooth upper combustion chamber surface, either in a preferred hemispherical shape or in configuration of a frustum of a cone. The improved combustion is a benefit which will be discussed below.

Figure 2:
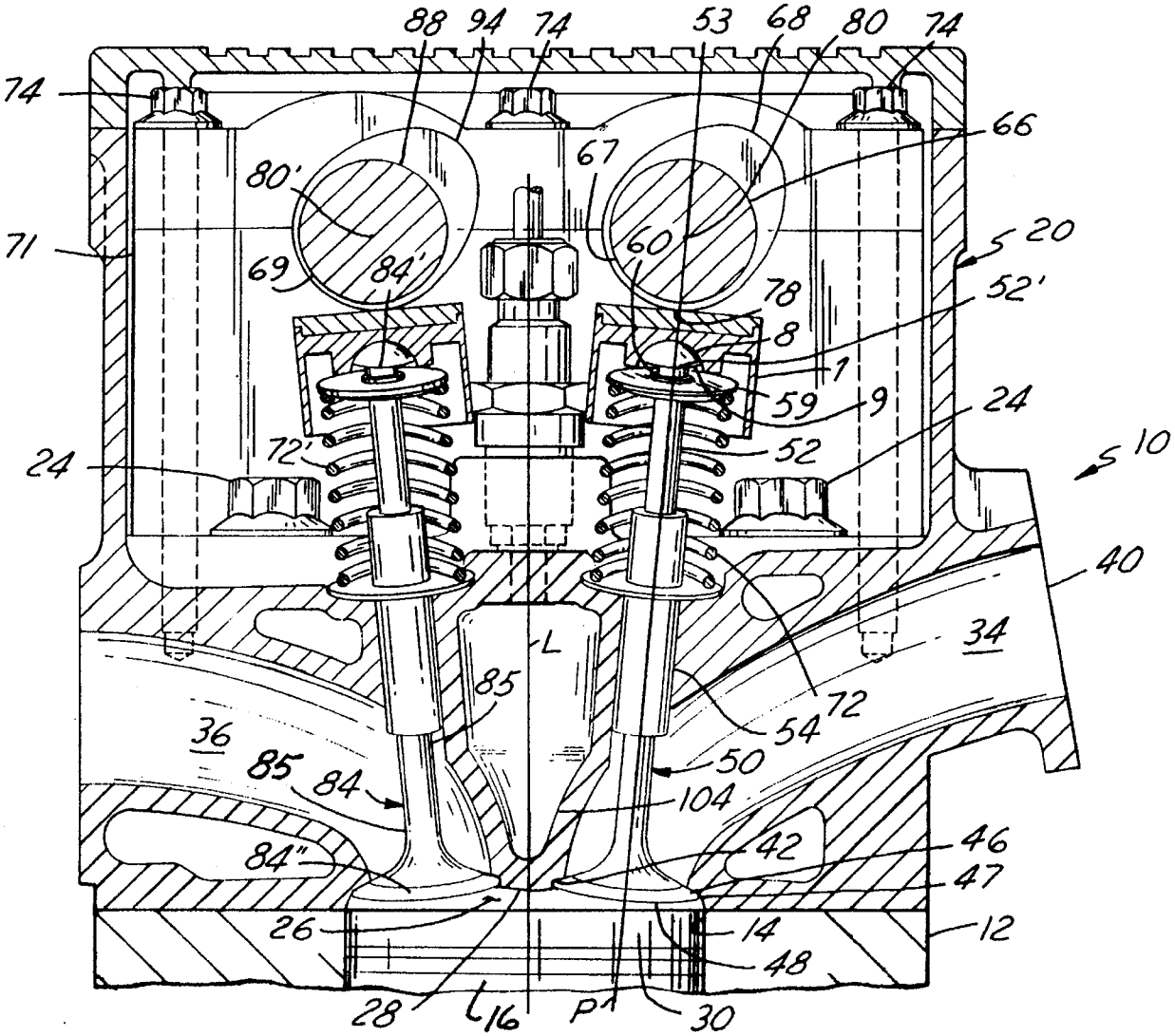
FIG. 2 is a cross-sectional view of a portion of an internal combustion engine utilizing the preferred embodiment of the invention, as applied to a small high-speed indirect injection diesel engine, with some parts broken away.

In FIG. 2, a cross-section of an internal combustion engine 10 is shown including an engine block 12 in which a plurality of cylinder bores 14 are formed, only one of which is visible. A piston 16 is mounted for reciprocating linear motion in each of the cylinders 14. As is well known in the engine art, the pistons are operatively coupled to a crankshaft (not shown) by a connecting rod (not shown) and piston pin (not shown).

A cylinder head 20 is mounted atop engine block 10 and is secured thereon by a plurality of elongated threaded fasteners 24. The cylinder head 20 is formed with concave recesses to form substantially hemispherical combustion chambers 26. One recess is aligned with each cylinder bore 14 and each recess is substantially the same diameter as the cylinder bore. The hemispherical concave wall 28 formed by a recess in the cylinder head cooperates with the upper convex surface 30 of piston 16 and with the side wall of the cylinder bore 14 to define an expandable and contractible combustion chamber.

As best illustrated in FIG. 2, the cylinder head 20 also has air intake and gas exhaust passages 34, 36, located, respectively, on either side of a longitudinally extending mid-plane (normal to the plane of FIG. 2) which plane includes axis L of the cylinder bore 14. Intake passage 34 leads from a flanged entrance 40 at one side of the cylinder head to an annular inlet opening 42 leading into combustion chamber 26. The peripheral edge defining inlet opening 42 has an inwardly tapered configuration forming an annular sealing seat 46. Seat 46 is engaged by a corresponding and like configured outer annular edge 47 of and enlarged head portion 48 of an intake valve 50. It should be noted that the intake valve 50 is one of a pair of identical intake valves for the combustion chamber 26 and that the other intake valve is located behind valve 50 in FIG. 2 and thus is not visible. The previous and following detailed description of valve 50 is applicable to the second intake valve.

Intake valve 50 has an elongated stem portion 52 that extends upwardly from its head portion 48. As explained previously, the elongated stem portion 52 has an axis 53 extending from origin point P located below hemispherical surface 28, past hemispherical recess or surface 28, through a guide sleeve 54 secured to cylinder head 20 and terminates at tip 52'. Note that in FIGS. 2 and 6 that axis 53 is angulated from the vertical as represented by axis L. The flat upper end portion or tip 52' abuts the flat end surface 9 of the rotular sliding pivot 8 as previously explained (see FIG. 1).

Figure 6:
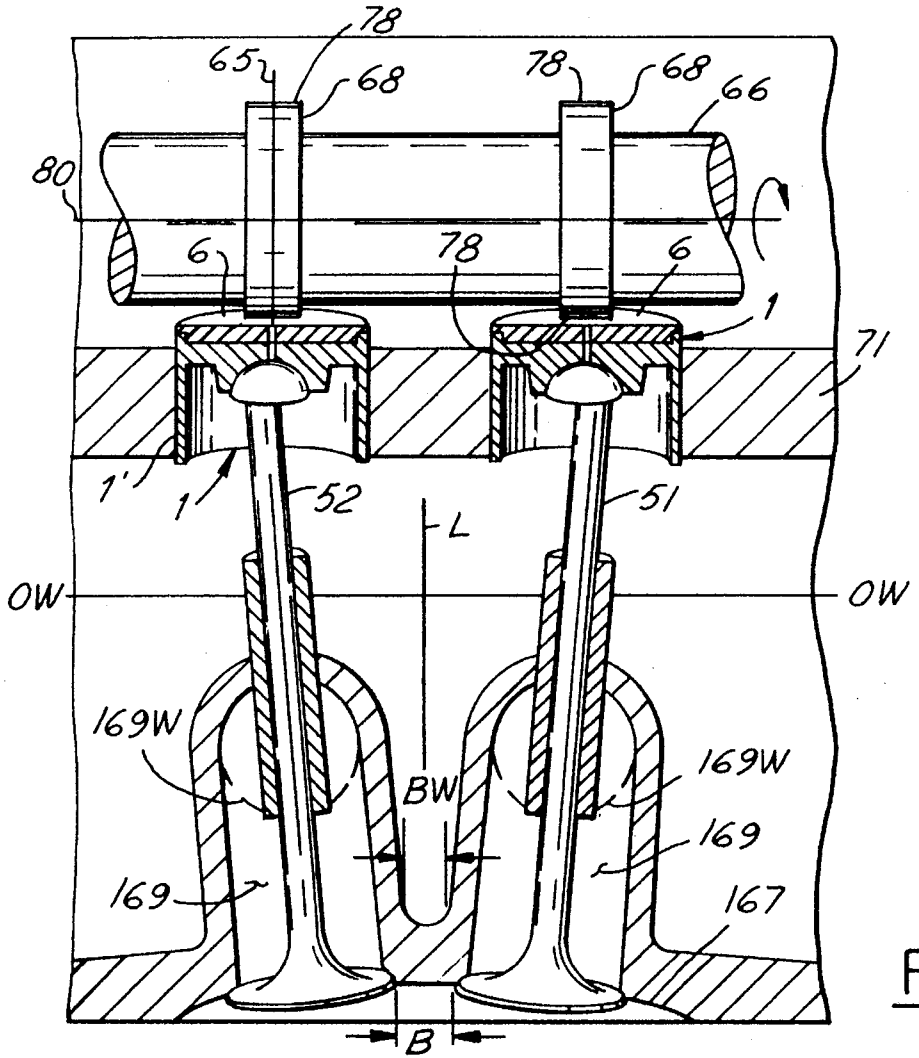
FIG. 6 is a diagrammatic side view taken generally along sight lines 6—6 of FIG. 5.

Referring specifically to FIG. 6, the tappet 1 is partly defined by cylindrical skirt 1' which is reciprocally mounted in a bore 64 formed in a support structure 71 which is attached to the cylinder head 20. Bore 64 guides movement of tappet 1 in a linear movement along an axis 65 in response to the action of the engine's camshaft 66. Specifically, as the camshaft is rotated, a cam lobe 68 slides over the upper surface of shim 6 or the top surface of the tappet 1, if shims are not employed. As best shown in FIG.2, the camshaft 66 is mounted for rotation in journals 67, 69 formed in a laterally extending portion of structure 71 which also supports the tappets. As shown in FIG. 2, structure 71 is secured to the cylinder head 20 by threaded fasteners 74.

As best shown in FIG. 6, the movement of cam lobe 68 across the upper surface of the tappet 1 causes downward displacement of the tappet along the axis 65. This movement compresses helical valve spring 72 shown in FIG. 2. Spring 72 extends between the upper surface of the cylinder head 20 and a retainer disc 59 which is secured to the valve stem 52 by locks 60. The actuation force causing valve opening moves tappet 1 along vertical axis 65. This actuation force is transmitted through the tappet's rotular sliding pivot mechanism 8 to valve stem 52. The resultant force transmission produces an axially directed force on the valve stem 52 to produce movement along the valve stem's axis 53. This movement moves the valve head 48 from its seat 46 to a more opened operative position so that air will pass from intake passage 34 into the combustion chamber 26.

As the camshaft lobe 68 slides past the top surface of the tappet 1, the compressed valve spring 72 releases energy to move valve 50 back toward its closed operative position in which the valve head 48 is seated with seat 46 to end intake air flow to the combustion chamber.

Figure 3:
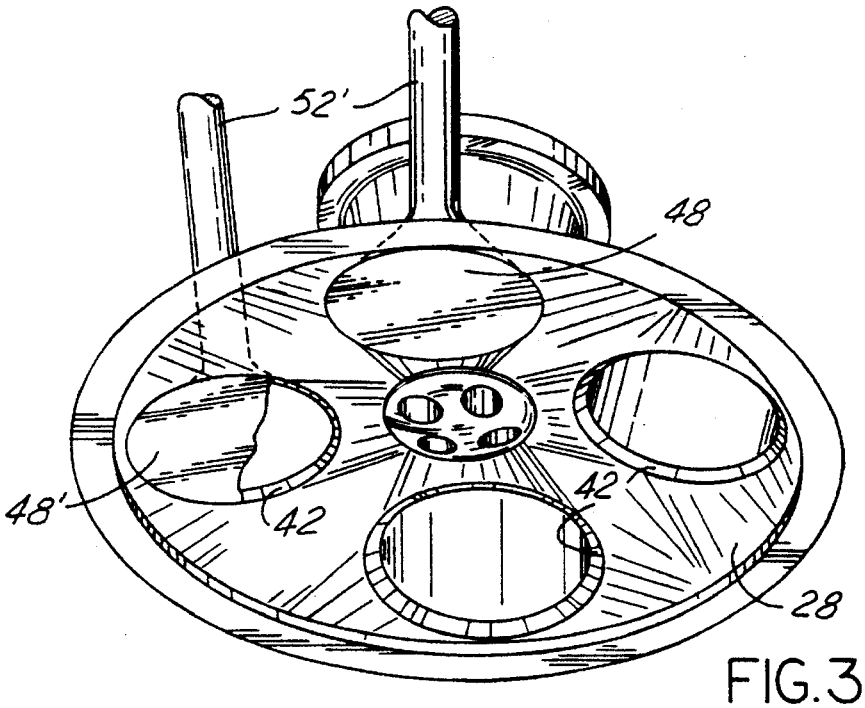
FIG. 3 is a pictorial view of a portion of a hemispherical combustion chamber of the engine of FIG. 2 with parts removed as generally sighted along arrow A of FIG. 2.

As best illustrated in FIGS. 2 and 3, the generally flat end surface 48' of the valve's enlarged head portion 48 lies substantially tangently to the hemispherical upper surface 28 of the combustion chamber 26. This produces a desirable smooth and even-walled combustion chamber. Undesirable pockets and crevices in the combustion chamber are avoided and this promotes increased burn efficiency of the air/fuel mixture which results in a cleaner engine.

Referring now to FIG. 6, the transverse outer faces 78 of cam lobes 68 extend parallel to the rotational axis 80 of cam shaft 66. Resultantly, the contact between face 78 and the surface of shim 6 extends evenly there across. The contact between surfaces 6 and 78 generates tappet movement along axis 65 evenly without undue wear at any particular points on the shim surface 6 or tappet face.

Figure 5:
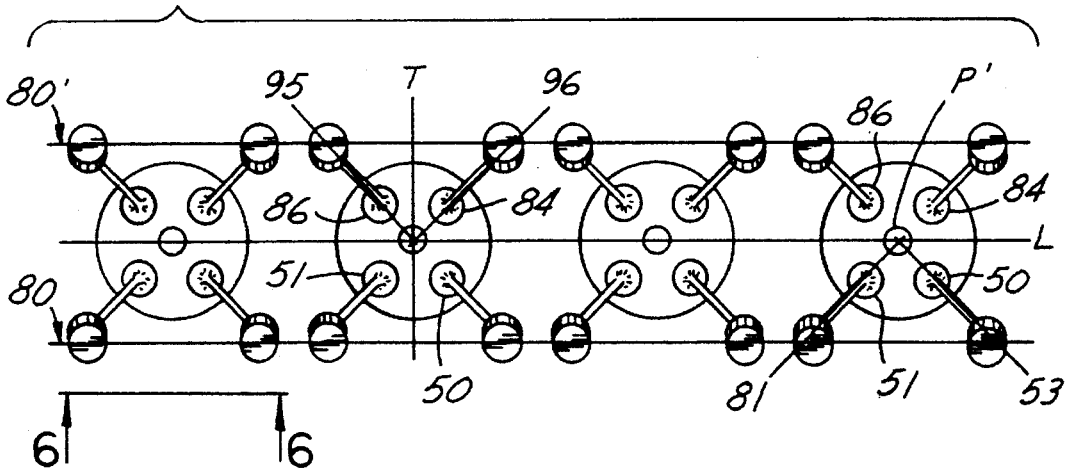
FIG. 5 is a diagrammatic top view of the engine of FIG. 2.

FIG. 5 is a top planar view of the engine cylinder arrangement which shows the engine's longitudinal axis and plane L normal to the surface of the drawing. Section lines 6—6 in FIG. 5 indicate the direction of view in FIG. 6 which shows camshaft axis 80 which is also parallel to longitudinal engine axis and plane L. FIG. 6 is shown devoid of non-essential elements for clarity to better reveal the action between cam lobes 66 and tappets 1. The cross-hatched section shows portions of the lower deck 167 of the cylinder head 20 and also portions of structure 71. Two intake ports or passages 169 are shown and two windows 169W in outline are revealed as the intersection of the passages at the outside flange where the intake manifold attaches. The line O/W diagrammatically indicates the approximate location of the cylinder head's oil shelf or where the separation is of the portion of the cylinder head lubricated by oil (space above line OW) from the portion of the head cooled by water jackets or passages (space below the line OW). The view reveals the exceptionally good water cooling provided for the bridge area located between the two passages or ports 167, 169. This can be appreciated by observing that the width of the bridge face in the combustion chamber labeled as "B" is about 9 mm, whereas the width of the jacket water labeled as "BW" is 7 mm, or closely the same width. With the subject valve train design, this occurs because the ports 167, 169 diverge from each other at double the angle that any one of the valves incline from the vertical. In the arrangements disclosed in the known prior art, if any pair of valves characterized by parallel stem portions created a 9 mm bridge therebetween, the ports or passages would have been artificially "bended" away from each other merely to obtain a 5 mm minimum core width between the valves. Resultantly, 3 mm of extra water passage or core width would be lost and bridge cooling would decrease along with air flow losses due to the required "bend" in the passages. Additionally, from a casting point of view, a sand core with a minimum radius of 3.5 mm which tapers outwards, is much stronger than a skinny and long one with minimum radius of 2.5 mm.

Figure 4:
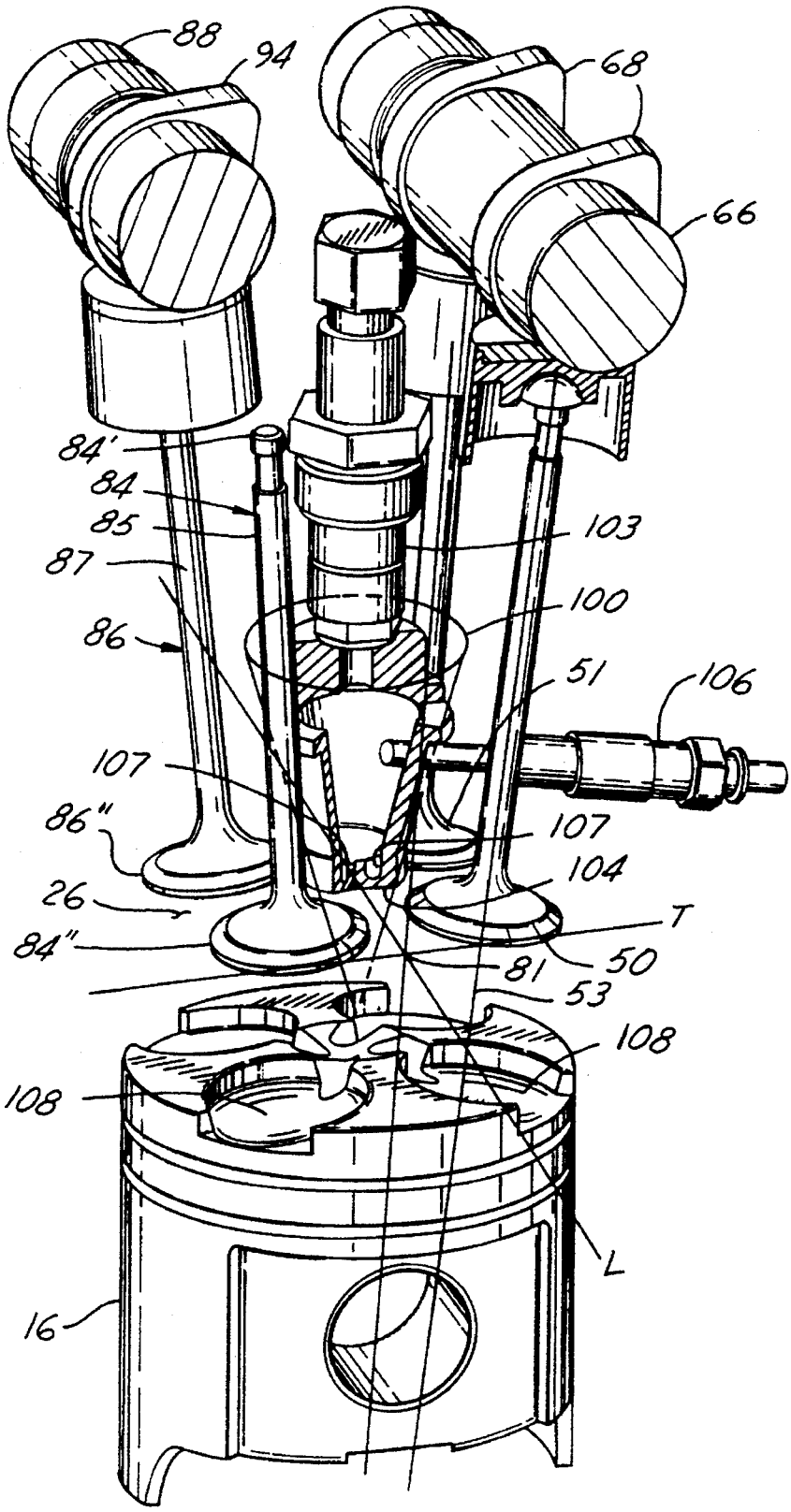
FIG. 4 is an exploded pictorial view of components of the engine of FIG. 2 with some parts removed and some parts broken away.

Still referring to FIG. 6, in addition to intake valve 50, a corresponding intake valves 51 is seen, as was previously described. However, as is best shown in FIGS. 4 and 5, the two intake valves are disposed on different axes, 53 for valve 50 and 81 for valve 51. The axes 51, 81 diverge outwardly from one another and from a centerpoint P. Accordingly, the axis 53 (and associated valve 50) and axis 81 (and associated valve 51) diverge outwardly from one another and are angled equally from the longitudinal and transversal planes L and T which extend through the engine as diagrammatically shown in FIG. 5. Lines 80 and 80' indicate the respective centerlines of the intake and exhaust camshafts.

As seen in FIGS. 2, 4 and 5, in addition to intake valves 50 and 51 there are provided a pair of exhaust valves 84 and 86 to control the exhaust of gases from the engine cylinder. Valves 84, 86 have substantially the same construction as the intake valves 50 and 51 and their tappets, return springs and other constructional details are like those associated with the intake valves. It is seen that the exhaust valves are positioned on an opposite side of the longitudinal plane L and are opposed in the transverse direction to the intake valves 50, 51.

As with the intake valves, the exhaust valves are moved to a more opened position by cam lobes 94 of camshaft 88 and are returned to their closed positions by valve closure springs 72' similar to helical spring 72 associated with the intake valve.

Similar to intake camshaft 66, the exhaust camshaft 88 has a plurality of cam lobes 94 which are responsible for opening the exhaust valves 84 and 86. The exhaust valves 84, 86 extend along radially and outwardly diverging axes 95, 96 as best shown in FIG. 5. More particularly, the axes 95, 96 of exhaust valves 84, 86 radiate from point P as shown in FIG. 2 and extend radially through hemispherical chamber wall 28 and terminate at an upper end portion or tip. The tip 84' of exhaust valve 84 is best shown in FIG. 4. With this arrangement, the enlarged valve head portions 84", 86" of valves 84, 86 are tangentially to the hemispherical surface 28 of the combustion chamber's upper wall. The stem portions of the valves 85, 87 diverge outwardly from one another and with respect to both the longitudinal and transversal planes L and T. Preferably, the angle of inclination of all the valves are equal with respect to the horizontal and transversal planes and the axis of their stem portions converge at a common point P along and low in the centerline of the cylinder bore 14. This may not be clear in FIG. 4 because it is an isometric rendition.

FIG. 4 depicts a divided chamber diesel engine with each valve angled outwardly from the combustion chamber with respect to both the longitudinal and transversal planes L and T, as shown in FIG. 4, a space shaped generally as a truncated cone 100 is provided. This space is advantageously employed so that a fuel injector 103 and a prechamber assembly 104 can be readily and centrally positioned directly adjacent and very close to combustion chamber 26 for improved engine operation. Due to the described valve train arrangement and construction, space 100 is much increased as compared to previous cylinder heads. The additional space desirably provides clearance for a glow plug 106 shown positioned to enter the precombustion chamber 104. Glow plug 106 approaches the chamber 104 through the large bridge formed between the two intake passages or ports (not detailed) of the intake valves 50, 51.

The following characterizes a proposed divided chamber diesel engine shown in FIG. 4. It has a 84.5 mm cylinder bore diameter and a 98 mm stroke, resulting in a cylinder displacement of 549.6 cubic centimeters. The rendition allows a Nominal Compression Ratio of about 20.0:1. The engine, with only about 25% of the total clearance volume in prechamber 104, features a reduced prechamber internal surface and therefore decreased heat losses therefrom. The prechamber may be similar to one disclosed in U.S. Pat. No. 5,392,744, which issued Feb. 28, 1995 to the applicant of this invention. The prechamber would preferably have four large, tapered transfer passages 107 (only two visible) which would decrease pumping work required for flow between the interior of the prechamber and the combustion chamber. Due to the close mating of valve heads with the hemispherical surface of the combustion chamber shown in FIG. 3, there is no appreciable crevice space or volume and there is sufficient clearance volume available to create relatively deep valve cutouts or pockets 108 in the top surface of pistons 16. These pockets a also serve as combustion pockets on the top of the pistons 16. On the intake passage side of the cylinder head, the deep pockets allow the intake valves to be opened or lifted about 4.7 mm when the piston and valve heads are at their closest spacing during intake and exhaust overlap. There is still sufficient clearance so that valves and piston will not contact one another. This relatively large intake valve lift during the overlap period of operation is achieved by advancing the intake camshaft a total of 50 crank angle degrees through a variable intake valve mechanism (not shown). The 50 advance degrees permits the intake valves to be closed, effectively, at 23 degrees ABDC. This results in an effective compression ratio of 18.7:1. This approach assures an efficient starting of the engine even at 0 degrees F within two seconds, without a prior pre-heat of the engine.

The above described functional results including improved combustion, are made possible by the subject valve train lay-out and construction which provides greatly increased space in the central portion of the cylinder head above each combustion chamber. The increased space permits use of a precombustion chamber with a desirable short flow path. Also, the previously described flush positioning of the valve heads along the surface 28 of the combustion chamber 26 effectively eliminates wasted volumes or crevices, and minimizes heat losses.

Figure 4A:
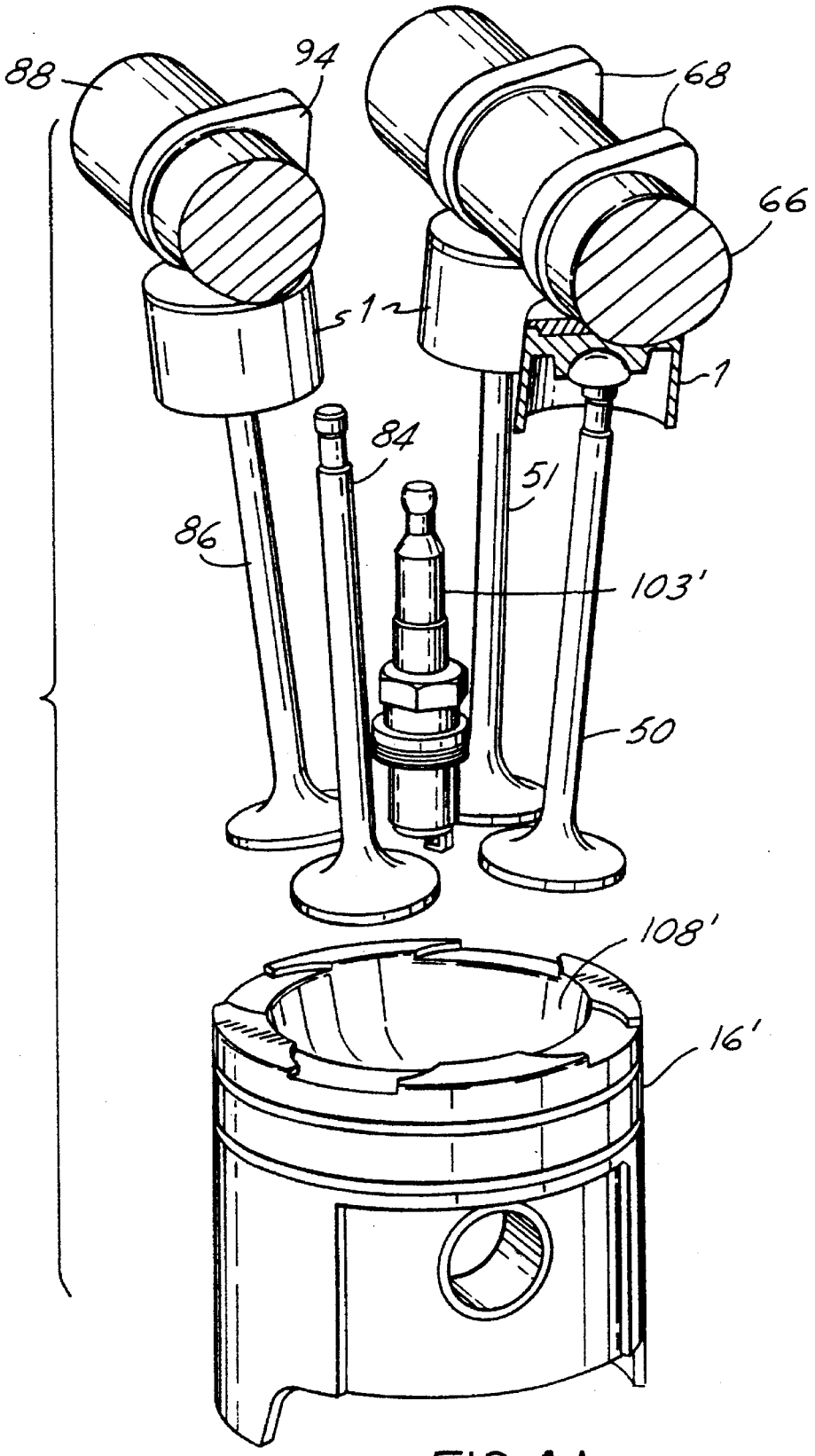
FIG. 4A is a view similar to the view of FIG. 4 illustrating a different version of an engine.

FIG. 4A illustrates a spark-ignited and homogeneous charged version of the same basic cylinder head and valve train structure as shown in FIG. 4. The engine essentially has an identical valve train and the piston 16' has a basic Heron type bowl chamber 108' formed on its top surface portion. The injector 103 and precombustion chamber 105 of FIG. 4 have been replaced by spark plug 103'.

As is well known, the sphere offers the lowest surface to volume ratio. Thus, a hemispherical combustion chamber minimizes the surface area of the combustion chamber in relation to its volume. This reduces heat losses to the coolant per mass or volume of fuel burned to improve thermodynamic efficiency. Also, the extent of cold-wall surface is minimized and resultantly the amount of fuel contacting the cold surfaces is reduced. Also, this reduces the degree of flame quench which is caused by contact with cold surfaces. It is known that hydrocarbon products adhere to cool surfaces and are later evacuated during the exhaust portion of the cycle. Thus, hydrocarbon emissions are minimized by the subject valve train and combustion chamber.

In diesel engines, heat transfer from the combustion chamber is detrimental when starting a cold engine because heat losses reduce compression temperatures and a diesel engine initiates combustion by rising the temperature of the compressed air. In combination with the splaying of the valves, which allows larger valves and more air flow, it should be appreciated that the subject valve train and cylinder head construction offers the greatest degree of utilization of the cylinder head surface for desirable purposes such as larger valves and bridges while minimizes negatives such as heat loss. Also, it provides a very significant increase in exhaust valve and bridge cooling.

Figure 7:
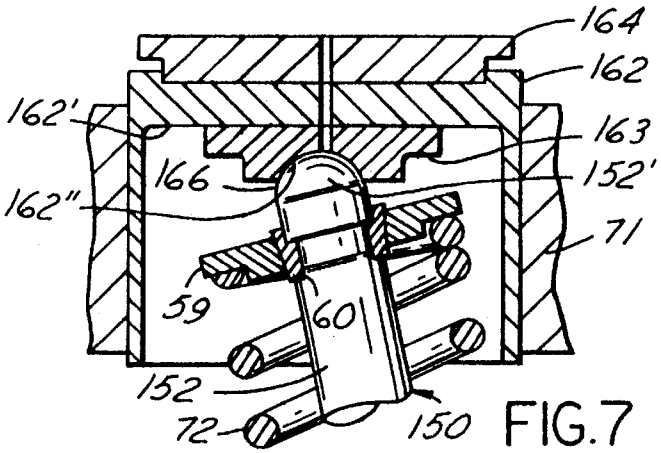
FIG. 7 is a cross-sectional view of one of the tappets and a portion of an associated valve stem illustrating one preferred embodiment of the invention.

Turning now to FIG. 7, a modification is shown of the tappet and rotular sliding pivot mechanism. The configuration of tappet 162 is similar to tappet 1 of FIGS. 1 and 2. Tappet 162 has a recessed top end which supports a shim member 164. To establish correct valve lash for valve 150, a shim having a particular thickness is selected from a set of shims of differing thickness. Optionally, the tappet may be shimless with the tappet's top surface establishing a solid surface for contact by a cam lobe. Alternately, the lash adjustment can be performed by selecting a correctly thickness sized rotular sliding pivot mechanism. In FIG. 7 a modified mechanism is shown including a member 163 with upper flat end surface 163' which is slidable along an abutting flat surface 162' of tappet 162 and with a hemispherical concavity 162" formed in an opposite end. A rounded end portion 152' of the valve's upper end portion or tip of the valve stem 152 mates with the concavity 162" for accommodating angulation between the axis of tappet 162 and the axis of stem portion 152. In this embodiment, both tappet 162 and sliding member 163 need not be located concentrically because the outside diameter of the member 163 is significantly smaller than the inside diameter of tappet 162. Consequently, member 163 can slide sideways along tappet surface 162'. By allowing the tappet to be located offset centrally from the centerline of the valve, design flexibility is enhanced which may be crucial in the successful design of the engine.

Figure 8A:
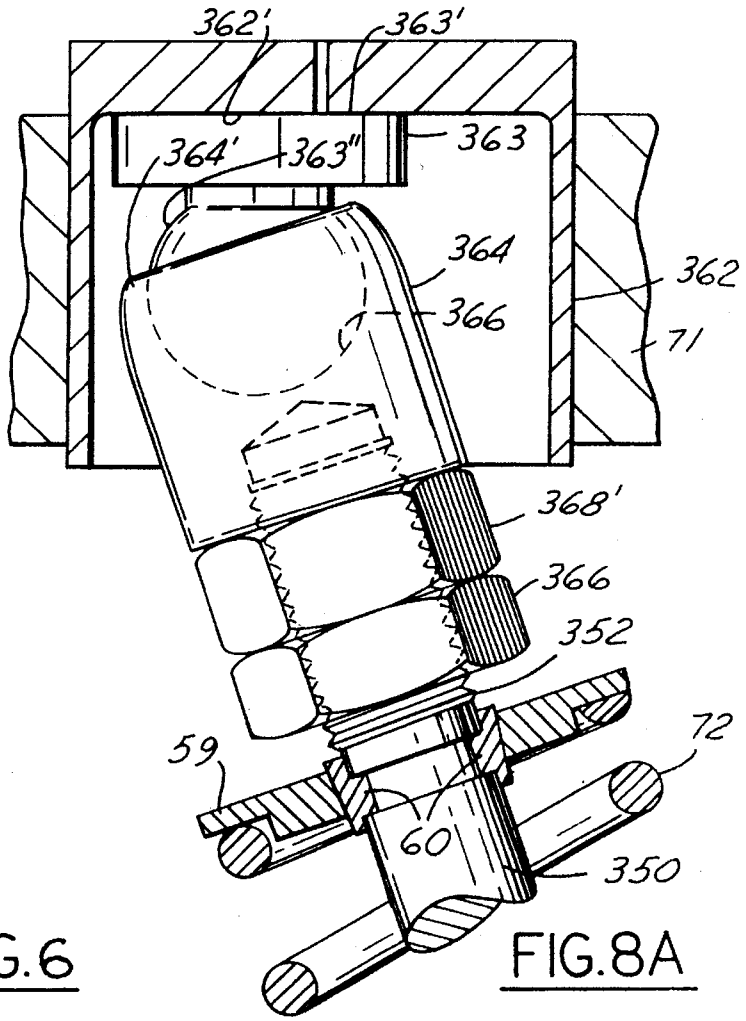
FIG. 8A is a modification of the embodiment of FIG. 8.
Figure 8:
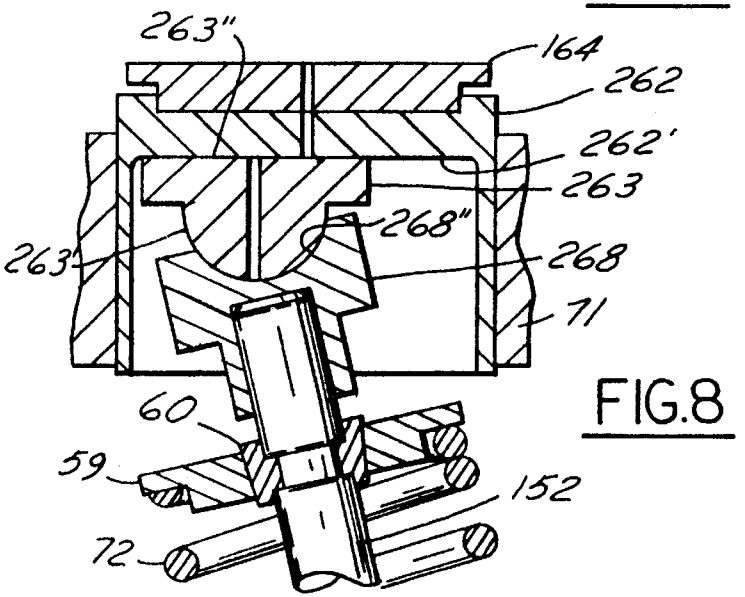
FIG. 8 is a cross-sectional view similar to that of FIG. 7 illustrating another preferred embodiment of the invention.
Figure 12:
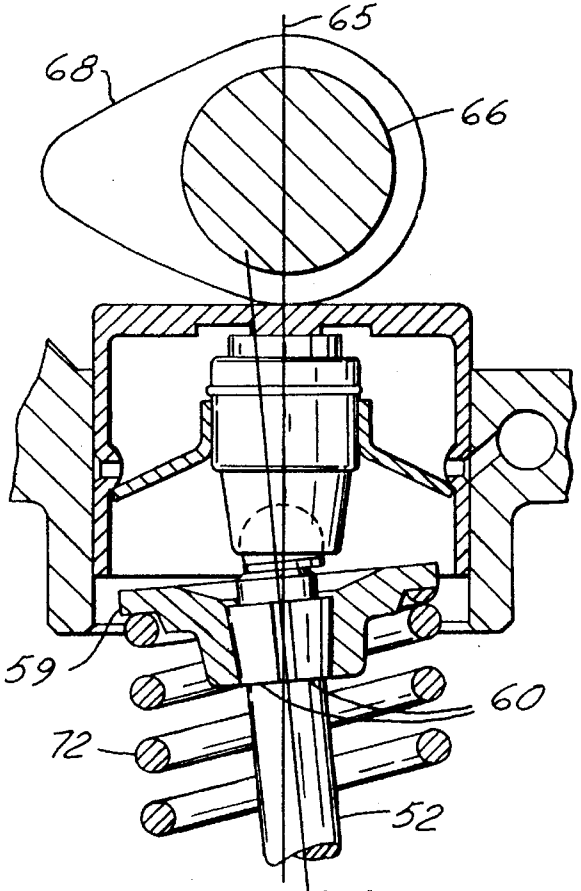
FIG. 12 is a cross-sectional view of a hydraulic inverted bucket tappet with a spherical swivel end.

In FIG. 8,an additional embodiment is shown in which the convex hemispherical configuration 263' which corresponds to the rounded hemispherical end 152' in FIG. 7 is formed on the slidable element or member 263. The concavity 268' corresponding to the concavity 162" in FIG. 7 is formed in a portion of a headed socket member 268 which is mounted on the upper end of the valve stem portion 152. The rotular sliding pivot 263 has a flat end surface 263" which is slidably supported against interior flat surface 262' of the tappet. As in the embodiment shown in FIG. 7, the diameter of member 263 is significantly smaller than the diameter of the surface 262' to permit centrally offset positioning and significant sliding motion therebeween. The convex hemispherical formation 263' on an opposite end of the rotular sliding pivot 263 may also be centrally offset for enhanced design freedom. Valve lash adjustments can be achieved by varying the axial thickness of either one, or the combination of the two elements 263 and 268.

FIG. 8A is a similar to the embodiment shown in FIG. 8 and thus is a derivative. In this embodiment, a tappet 362 has an alternate shimless design with an interior flat surface 362'. A slidable member 363 with a flat upper end surface 363' is mounted against the downwardly facing surface 362'. Member 363 also supports a hemispherical portion 363" on an opposite end from end surface 363'. A headed socket member 364 faces the hemispherical portion 363" and defines a hemispherical concavity 366 corresponding to the concavity 268" in FIG. 8. The hemispherical portions 363" and 366 mate with one another to accommodate differences in angularity between the axis of tappet 362 and the axis of valve stem portion 350. Socket member 364 also has an internal threaded bore adapted to thread over and about the threaded upper end portion or tip 352 of valve stem portion 350. The lower, exterior surface of member 368 is formed with a hexagonal configuration 368' so that the member 368 can be turned with a tool such as a wrench to adjust for valve lash. The selected position is locked in a desirable place with a lock nut 366. With this design, lash adjustments can be made with common wrenches and feeler gages, very quickly, without disrupting the assembly. A subassembly of members 363 and 368 can be achieved by rolling the edge 364' of socket member 364 over the spherical end 363".

Figure 9A:
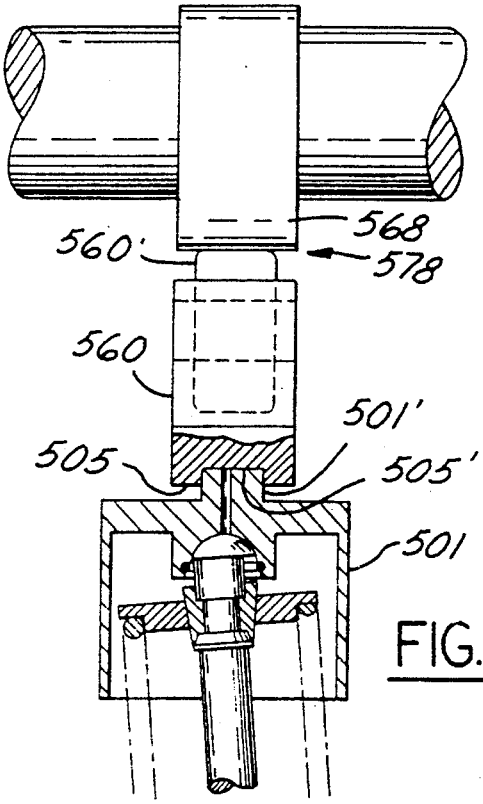
FIG. 9A is a cross-section view of FIG. 9 taken generally along lines 9A—9A of FIG. 9 with parts removed and some parts shown in full lines.
Figure 9:
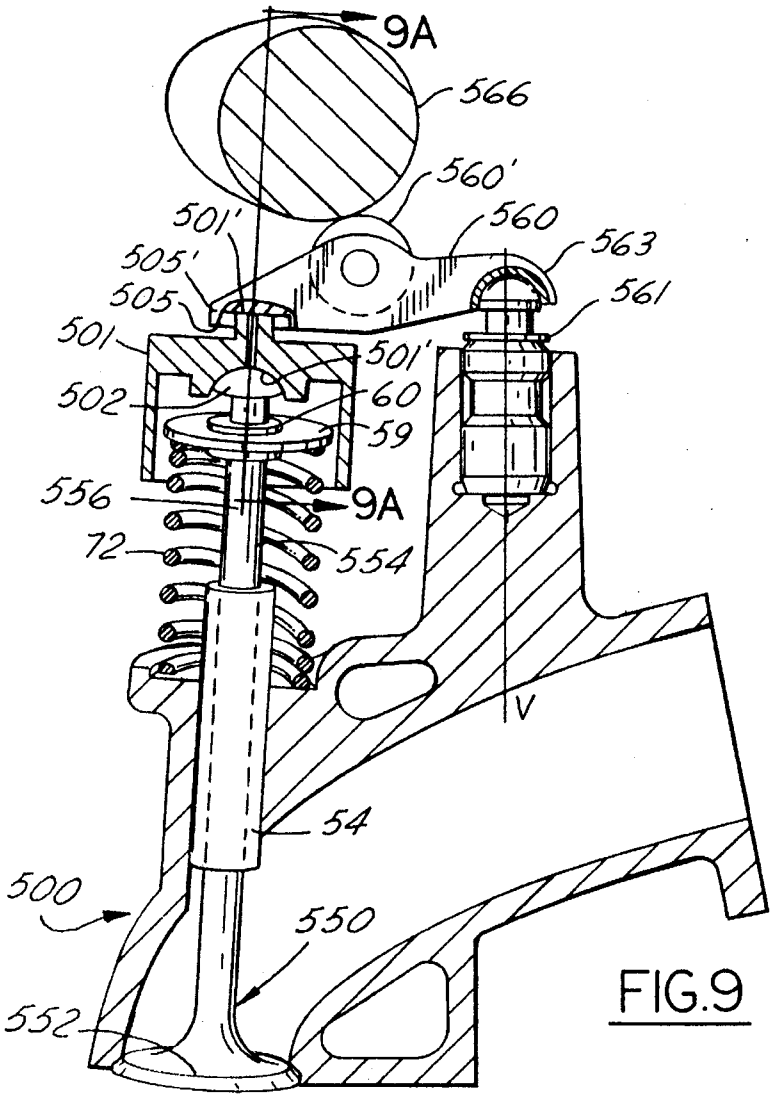
FIG. 9 is a cross-section view of a transverse section of the fundamental elements of a four valve, DOHC roller finger-follower valve train in a cylinder head, with most of the peripheral elements cut-away.

In FIG. 9, a portion of a cylinder head 500 is shown in another embodiment wherein the cylinder head supports intake valve 550 and other ancillary valve train elements such as valve guide 54, coil spring 72, spring disc 59, and retainers 60. These elements are the same as the elements in FIG. 2 and are numbered the same. Valve 550 has an enlarged head portion 552, an elongated stem portion 554, and an upper end portion or tip 556. Above valve tip 556, an inverted-bucket type tappet 501 is shown which is similar to tappet 1 as shown in FIGS. 1 and 2. Likewise, the concavity 501' formed in tappet 501 is similar to the concavity 3 of tappet 1. Likewise, the rotular sliding pivot mechanism 502 is similar to the mechanism shown associated with tappet 1. However, unlike the direct acting overhead camshaft shown in FIG. 2, the camshaft 566 in FIG. 9 acts directly upon a finger follower 560 rather than on the tappet. The rightward end portion 563 of follower 560 is supported on an end of a hydraulic lash compensator 561. Both of these components 560, 561 are known in the art of present day engines. Finger follower 560 supports an anti-friction roller element 560' at its midportion and generally extends in a transverse plane of the engine. The axis of the roller element 560' extends parallel to the axis of camshaft 566, with line contact between the periphery of the roller 560' and the cam lobe 568 along a line (not shown) parallel to the axis of the camshaft. Since lash compensation is hydraulic, no shims of varying thickness are required, but one (not shown) may be provided as a wear pad. The leftward end of the finger follower operationally engages the top of the inverted-bucket tappet 501.

Reference is made to FIG. 9A showing a side elevational view of the valve mechanism along sight line 9A—9A of FIG. 9. This side view reveals a grooved formation on the bottom 505 of the left end portion of finger follower 560. The groove 505' is shown engaging and about a cylindrical protrusion or tab 501' which integrally extends upward from the central portion of the tappet's top surface. Alternately, if a shim is used, the tab would be integral with the shim. The arrangement with groove 505' straddling tab 501' secures the end portion of finger follower 560 and inhibits rotation about a vertical axis "V" at the pivoted rightward end 563. Thus, follower 560 is prevented from being removed from the top of the tappet and a straight line contact 578 is maintained between cam lobe 568 and the roller element 560'.

Figure 11A:
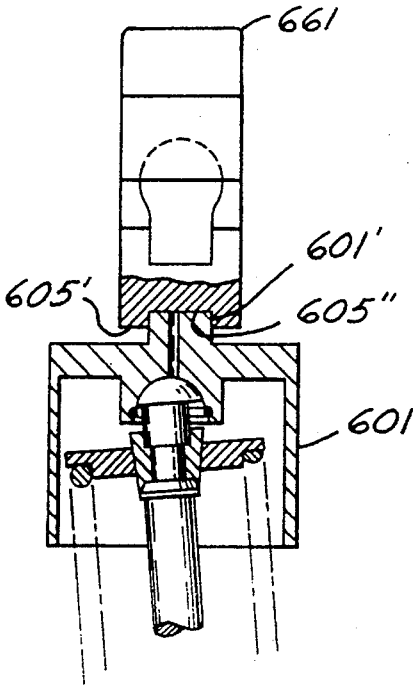
FIG. 11A is a modification of the structure of FIG. 11.
Figures 10, 11:
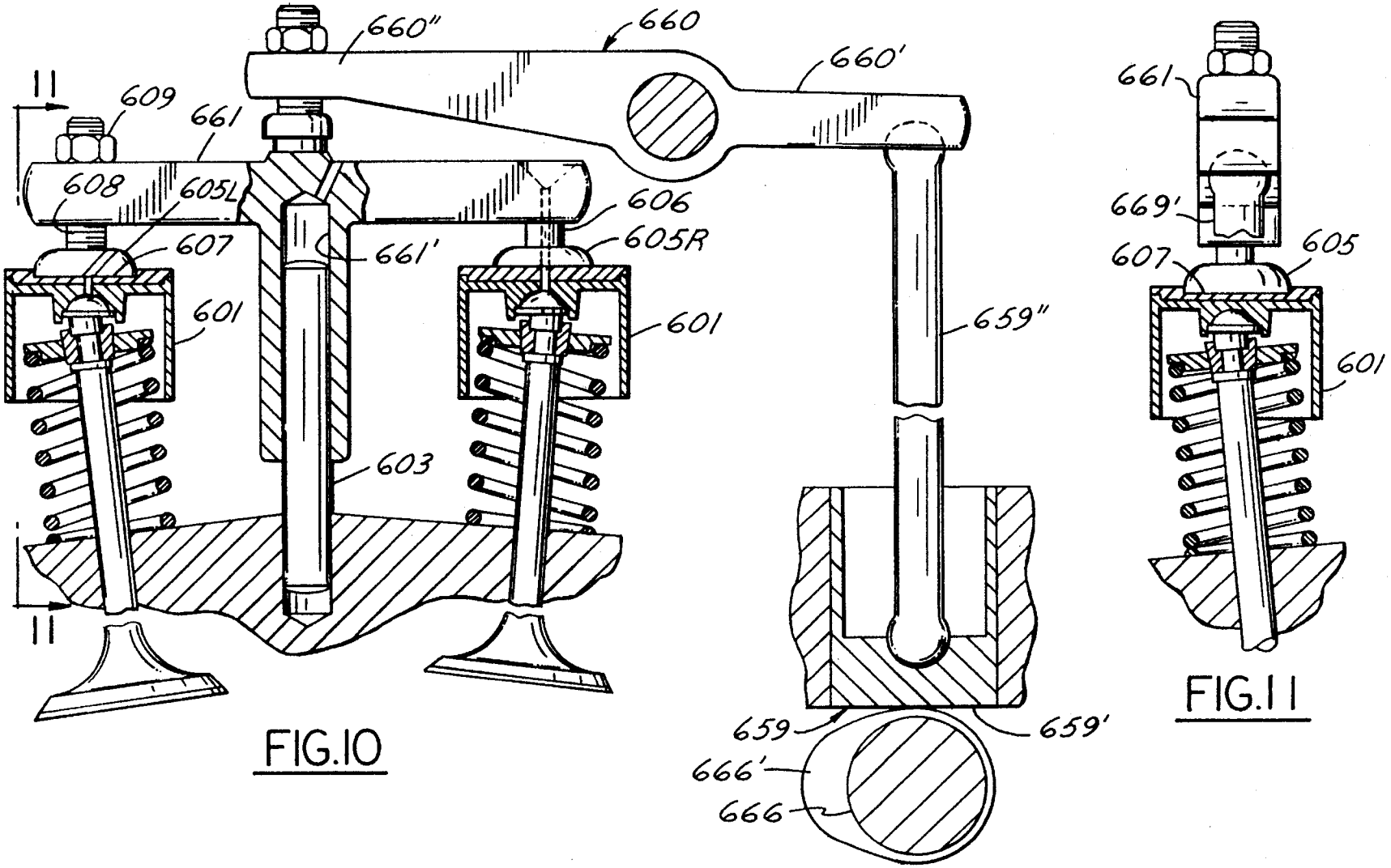
FIG. 10 is a cross-sectional view of a section of a four valve arrangement in which valves are actuated by a single engine block mounted camshaft which engages conventional tappets, and push rods, rocker arms and bridges are used to transmit valve opening forces to the valves.
FIG. 11 is a longitudinal cross-sectional view taken generally along sight lines 11—11 of FIG. 10.

In FIGS. 10 and 11, a cam mechanism for simultaneously actuating multiple tappets together is shown. Large truck, industrial and marine engines have used a similar arrangement for a number of years. An in-block mounted camshaft 666 or a camshaft in the cylinder head rotates cam lobes 666' which engage a surface 659' of a conventional tappet 659. The action caused by the cam lobe moves a push rods 659" which in turn pushes against the rightward end 660' of a rocker arms 660. Rocker arm 660 is pivotally mounted upon a shaft as shown. The leftward end portion 660" engages a central portion of a T-shaped bridge member 661. Member 661 has a central portion with a generally vertical bore 661'. The member 661 is supported by an elongated dowel member 603 which is attached at a lower end to the cylinder head and extends upward therefrom. This permits the member 661 to move upwards and downwards along the dowel member 603.

Both end portions of the T-shaped bridge member 661 support foot devices 605 which engage a respective tappet 601. The rightward foot device 605R is attached to the rightward end portion of member 661 by a short axle 606. The leftward foot device 605L is attached to the leftward end portion of member 661 by a threaded shaft 608 and lock nut 609. To prevent rotation of the member 661 about the axis of dowel 603, at least one of the two foot devices 605 is mounted in a depression 607 formed in the top surface of a corresponding tappet 601.

Alternatively, as shown in FIG. 11A, rotation of the T-shaped bridge member 661 about the dowel 603 can be prevented by forming a groove 605" in the bottom surface 605' of one of the end portions or arms. Preferably the one leg which has no lash adjustment function is selected. The groove 605" is formed along the horizontal axis of the member 661 which corresponds to a direction parallel to the engine's transverse plane. The groove 605' abuts and engages a cylindrical protrusion or tab 601' which is extends from the upper surface of the tappet 601 or alternately, from a shim or wear pad.

FIG. 10 shows in an elevational end sectioned view the inclination from the vertical of a pair of valves (intake or exhaust) in a transverse plane of the engine. FIG. 11 is a side elevational view along sight line 11—11 of FIG. 10. It shows the inclination from the vertical of one of the valves in a longitudinal plane of the engine. The angle of inclination of the valves in either plane is the same or very close to the same.

ENGINES WITH MORE OR LESS THAN FOUR VALVE PER CYLINDER

While previously described embodiments of this invention concerned engines with two intake valves and two exhaust valves, the subject valve train arrangement and configuration can be profitably employed with greater or lesser numbers of intake and exhaust valves than four. For example, in FIG. 13, three intake and three exhaust valves are employed. The enlarged head portions 800', 802', 808', 814', 816', and 818' of the valves 800, 802, 808, 814, 816, and 818 are within the periphery of the hemispherical combustion chamber shown by the circle "C" in FIG. 13.

The two exhaust valves 800, 802 angulate from the vertical in both the engine's longitudinal and transverse planes L, T. They are engaged, respectively, by tappets 804, 806 mounted to move along a vertical axis as with the valves in the previous four valve engines. Tappets 804, 806 have rotular sliding pivot mechanisms. The center exhaust valve 808 angulates outwardly from the vertical only in transverse plane T of the engine and not in a longitudinal plane. Thus, its tappet 810 is mounted to move along a different axis than tappets 804, 806. Tappet 810 also has a rotular sliding pivot mechanism.

Figure 13:
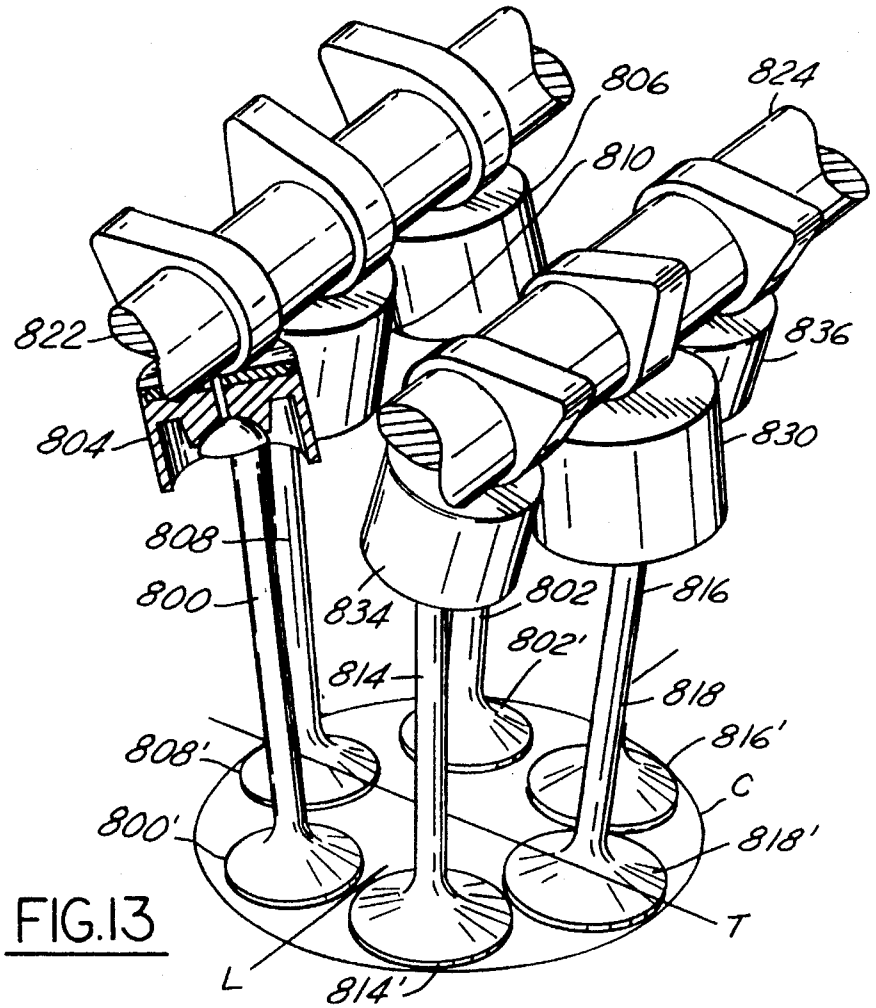
FIG. 13 is a pictorial view illustrating another arrangement of the invention.

The same arrangement of the valves and tappets are used on the intake side of the cylinder head for intake valves 814, 816 and 818. Therefore, the explanation of angulation and mounting of tappets is similar and will not be repeated. Opening of the exhaust and intake valves are operated by the cam lobes of associated exhaust and intake camshafts 822, 824, as is shown in FIG. 13. With this construction as an example, it can be appreciated that an even larger number of valves with different angularities for each set of equal function valves may be operated by a single camshaft. With the valve train design of this application, increased central space between the valves and directly above the combustion chamber is available so that standard size spark plugs, prechambers and fuel injectors can be used even on smaller engines.

The orientation of the centers of all tappets on the same line along the contacts with the camshaft lobes may not be readily obvious from FIG. 13 because this is an isometric view. However, such alignment and disposition is required for this design to operate desirably. From FIG. 13 it should be appreciated that the size or diameter of tappet 810 on the exhaust side and 830 on the intake side is greater than the remainder of tappets 804, 806 on the exhaust side and 834, 836 on the intake side. The greater diameter of tappets 810, 830 is needed due to the fact that tappets 810, 830 are offset on the transverse plane of the cylinder and engine and from the axial centerline of the camshaft and must be made larger to prevent the camshaft lobe from excessively loading the edge of the tappet.

While several embodiments of the invention have been shown and described, other embodiments are contemplated and will become apparent to those skilled in the art after studying this application. Accordingly, the invention should not be limited to only that which is shown and described but by the following claims.

What is claimed:

1. A valve train for an internal combustion engine having an engine block with cylinders therein and a cylinder head, a piston operatively disposed in each of said cylinders, each of said cylinders and said piston therein defining a first end portion of a combustion chamber, said cylinder head operatively disposed on said engine block and having curved recesses therein aligned with said cylinders to define second end portions of said combustion chambers, intake and exhaust valves supported by said cylinder head, each of said combustion chambers having at least first and second intake valves and first and second exhaust valves associated with each cylinder, valve seats formed in said cylinder head for each of said valves, each of said valves having an enlarged head portion to sealing engage an associated one of said valve seats and each of said valves further having an elongated stem portion which extends from said enlarged head portion through an associated stem openings in said cylinder head and terminating at an upper end portion, each of said stem portions defining an axis with each axis being inclined with respect to one another and arranged so that each axis diverges away from the axes of other stem portions, a tappet located adjacent said upper end portion of each valve stem portion and being supported by said cylinder head for movement along an axis which is angulated with respect to the axis on an associated valve stem portion, a camshaft supported for rotation by said cylinder head, said camshaft having a lobe portion corresponding to each one of said tappets wherein said lobe portions engage said tappets at contact surfaces which extend in a plane parallel to the centerline of the camshaft, said engagement of said camshaft lobe with said tappet during rotation of said camshaft produces movement of the tappet along its axis, each tappet having a pivotal force transmitting connection means for contact with said upper end of said associated valve stem to accommodate the angularity between the axis of said tappet and the axis of said associated valve stem portion wherein the connection means permits rotating and sliding movements between said tappet and said valve stem portion.

2. A valve train for an internal combustion engine having an engine block with cylinders therein and a piston operatively disposed in each of said cylinders to define one end portion of a respective combustion chamber, a cylinder head operatively disposed on said block and having curved recesses therein aligned with said cylinders to define respective second end portions of said combustion chambers, at least first and second intake valves and first and second exhaust valves provided in said cylinder head for each of said cylinders, valve seats formed in said cylinder head for each of said intake and exhaust valves, each of said valves having an enlarged head portion for sealingly engaging an associated one of said valve seats, and each of said valves further having an elongated stem portion extending from said enlarged head portion through an associated stem opening in said cylinder head and terminating at an upper end portion, each of said stem portions defining an axis and with each axis being inclined so as to diverge away from the axes of any other of said stem portions, an inverted bucket tappet associated with each of said valves and being supported in said cylinder head adjacent said upper end of said valve stem and being movable along an axis which is angulated with respect to the axis of said associated valve stem portion, a camshaft supported for rotation by said cylinder head, said camshaft having a lobe portion corresponding to each said tappets wherein said lobe portions engage said tappets at contact surfaces which extend in a plane parallel to the centerline of the camshaft, said engagement of said camshaft lobe with said tappet during rotation of said camshaft produces movement of said tappet along its axis, each tappet having a universal joint disposed adjacent a bottom of said inverted bucket tappet to allow angularity between the two divergent axes of said tappet and said valve stem respectively wherein the universal joint permits rotating and sliding movements between said tappet and said upper end portion of said valve stem portion.

3. A valve train for an internal combustion engine having an engine block and a cylinder head, a piston operatively disposed in each of said cylinders to define one end portion of a respective combustion chamber therein, said cylinder head having curved recesses therein aligned with said cylinders to define respective second end portions of said combustion chambers, intake and exhaust valves provided in said cylinder head for opening and closing said cylinders, at least first and second intake valves and first and second exhaust valves for each of said cylinders, valve seats formed in said cylinder head for each of said valves, each of said valves having an enlarged head portion for sealingly engaging an associated one of said valve seats and each of said valves further having an elongated stem portion extending from said enlarged head portion through associated stem openings in said cylinder head and terminating at an upper end portion, each of said stem portions defining an axis which is inclined so as to diverge away from the axis of any other of said stem portions, an inverted bucket tappet associated with each of said valves, said tappet being mounted in said cylinder head adjacent said upper end of an associated valve for movement of said tappet along its axis which is angulated with respect to the axis of said associated valve stem portion, corresponding to movement of said associated valve, a camshaft supported for rotation by said cylinder head, said camshaft having a lobe portion corresponding to each one of said tappets wherein said lobe portions engage said tappet at contact surfaces which extend in a plane parallel to the centerline of said camshaft, said engagement of said camshaft lobe with said tappet during rotation of said camshaft producing movement of said tappet along its axis, each tappet being associated with a spherical swivel joint mechanism disposed at the bottom of said tappet to allow angularity between the axis of said tappet and the axis of said associated valve stem portion by permitting a sliding motion and a rotating motion between a portion of said spherical swivel joint and the upper end portion of said valve stem.

4. A valve train and cylinder head as set forth in claims 1, 2 or 3 in which every valve associated with a particular cylinder is angled with respect to the centerline of said cylinder an equal amount in both the longitudinal and the transversal directions of the engine, said recesses in said cylinder head having a hemispherical configuration wherein said valve axes radiate outwardly from the surface of said hemispherically configured combustion chamber and with said enlarged head portions of said valves disposed tangentially to the surface of said hemispherical combustion chamber.

5. The valve train including said bucket tappet as set forth in claim 3, said swivel joint mechanism including a loose hemispherical element with an end disposed into a hemispherical concavity which is integrally formed by said tappet, said loose hemispherical element further having a flat portion abutting the upper end portion of the associated valve stem wherein said loose hemispherical element allows free rotation between said valve and said tappet to accommodate angulation between the axial centerline of the tappet and the centerline of said valve stem thereby permitting said flat portion and said upper end of said valve stem to slide sideways with respect to one another.

6. The valve train as set forth in claim 5 and retaining means for securing said loose hemispherical element within said hemispherical concavity.

7. The valve train as set forth in claim 6 wherein said retaining means is in the form of a metal ring inserted in a cylindrical groove which is located adjacent the bottom portion of said tappet adjacent said hemispherical concavity, said metal ring preventing said loose hemispherical element from moving out from said hemispherical concavity without affecting the mechanical function of said swivel joint mechanism in accommodating angularity between the axes of said tappet and said valve stem.

8. The valve train including said bucket tappet as set forth in claim 5 wherein valve lash adjustment is adjusted by varying the axial thickness of said loose hemispherical element.

9. The valve train as set forth in claim 3, said spherical swivel joint mechanism including a loose element which has a large diameter cylindrical portion with one flat end surface located in abutting relationship to said tappet and an opposite end surface forming a hemispherical concavity into which extends said upper end portion of said valve stem, said upper end portion being convexly contoured so as to mate with said hemispherical concavity.

10. The valve train as set forth in claim 9 in which the axial centerline of the tappet is offset from a center location on said cylindrical end of said loose element and in which a resultant operative contact patch between said flat contact surfaces are free to slide sideways relative to one another.

11. The jointed inverted bucket tappet as set forth in claim 9 wherein valve lash adjustment is adjusted by varying the axial thickness of said loose hemispherical element.

12. The valve train as set forth in claim 3, said swivel joint mechanism composed of two loose elements, a first element having a large diameter cylindrical portion with one flat end abutting the bottom of said bucket tappet and another opposite end forming a convex spherical surface, a second element having one end forming a hemispherical concavity adjacent the convex spherical surface of the first element and a second end forming a cylindrical cavity into which is disposed said upper end portion of said valve stem.

13. The valve train as set forth in claim 12 in which valve lash adjustment is achieved by varying the axial thickness of one of said elements of the swivel joint mechanism.

14. The valve train as set forth in claims 12 in which the cylindrical cavity formed at the bottom end of the second element has an internally threaded connection to an externally threaded end of said upper end portion of said valve stem and in which the outside of the elongated end of the second element is formed with flat surfaces.

15. The valve train as set forth in claim 14 in which the axial movement between said internally threaded bottom end of said second element of said swivel joint and said externally threaded upper end portion of said valve stem is used to adjust for valve lash.

16. The valve train set forth in claim 15 in which the axial movement between said internally threaded bottom end of said second element of said swivel joint and said externally threaded upper end portion of said valve stem is inhibited from movement by a lock nut threaded onto the threaded tip of said valve stem.

17. The valve train as set forth in claim 12 in which the axial centerline of the tappet is offset from a center location on the flat end-surface of the cylindrical end of the first element of the swivel joint mechanism interposed between the bottom of the tappet and said upper end portion of said valve stem, and wherein the contact path between said flat end of said tappet operatively shifts sideways with respect to said flat end surface of said cylindrical end of said first element of said swivel joint mechanism.

18. The valve train as set forth in claim 3, in which said inverted bucket tappet supports an internal hydraulic piston and body for automatic valve lash compensation, said swivel joint mechanism being formed by a hemispherical member partially encapsulated at the bottom end of said hydraulic piston, said hemispherical member having an outside exposed portion at its bottom end consisting of a flat end surface abutting said flat upper end portion of said valve stem.

19. The valve train as set forth in claim 18 in which said hydraulic piston forms a concave cavity at its bottom end, and said hemispherical member forms a conforming surface to said concave cavity so to permit said hemispherical member to freely oscillate and rotate within the concave cavity.

20. The valve train as set forth in claim 18 in which the center of said flat bottomed hemispherical member is offset from the center of said upper end portion of said valve stem.

21. The valve train as set forth in claim 1, including a cylindrical cavity formed in the top portion of said tappet and a loosely supported shim located partially within said cylindrical cavity, centrally located holes both in said tappet extending parallel to the axis of said tappet and in said shim extending parallel to the longitudinal axis of said shim for lubricating said pivotal force transmitting mechanism between said tappet and said upper portion of said valve stem.

22. The valve train as set forth in one of claims 1 or 3 in which another valve and associated tappet is added to said two valves and tappets which are disposed to one side of a longitudinal plane of the engine and cylinder head, and said additional tappet is shifted from centered alignment with the axis of the camshaft along a transverse plane of the engine and cylinder head, said additional tappet having a different diameter than the diameters of the said two tappets.

* * * * *